US008061087B2

(12) United States Patent
Ray

(10) Patent No.: US 8,061,087 B2
(45) Date of Patent: Nov. 22, 2011

(54) RETROFIT FRAMING SYSTEM FOR METAL ROOF

(76) Inventor: Gino Ray, Slidell, LA (US)

( * ) Notice: Subject to any disclaimer, the term of this patent is extended or adjusted under 35 U.S.C. 154(b) by 120 days.

(21) Appl. No.: 12/460,638

(22) Filed: Jul. 22, 2009

(65) Prior Publication Data

US 2011/0016803 A1 Jan. 27, 2011

(51) Int. Cl.
*E04B 7/02* (2006.01)

(52) U.S. Cl. ..... 52/90.2; 52/66; 52/22; 52/336; 52/749.12; 52/203

(58) Field of Classification Search ..... 52/90.1, 52/90.2, 66, 22, 643, 276, 93.2, 648.1, 302.1, 52/198, 336, 506.06, 508, 749.12, 203
See application file for complete search history.

(56) References Cited

U.S. PATENT DOCUMENTS

| | | | | | |
|---|---|---|---|---|---|
| 2,284,898 | A * | 6/1942 | Hartman | 52/654.1 |
| 3,583,121 | A * | 6/1971 | Tate et al. | 52/22 |
| 3,845,930 | A * | 11/1974 | Metrailer | 249/29 |
| 4,263,763 | A * | 4/1981 | Bouwens | 52/404.3 |
| 4,314,428 | A * | 2/1982 | Bromwell | 52/22 |
| 4,494,342 | A * | 1/1985 | Decker | 52/203 |
| 4,524,554 | A * | 6/1985 | Simpson | 52/693 |
| 4,593,509 | A * | 6/1986 | Linton | 52/262 |
| 4,608,791 | A * | 9/1986 | McClure | 52/90.2 |
| 4,620,397 | A * | 11/1986 | Simpson et al. | 52/66 |
| 4,651,493 | A * | 3/1987 | Carey | 52/710 |
| 4,691,491 | A * | 9/1987 | Lilley | 52/22 |
| 5,005,323 | A * | 4/1991 | Simpson et al. | 52/90.2 |
| 5,038,529 | A * | 8/1991 | Conley et al. | 52/14 |
| 5,127,205 | A * | 7/1992 | Eidson | 52/520 |
| 5,511,354 | A * | 4/1996 | Eidson | 52/544 |
| 5,704,170 | A * | 1/1998 | Simpson | 52/90.1 |
| 5,743,063 | A * | 4/1998 | Boozer | 52/713 |
| 6,301,853 | B1 * | 10/2001 | Simpson et al. | 52/520 |
| 6,397,527 | B1 * | 6/2002 | Pellock | 52/90.1 |
| 7,208,081 | B2 * | 4/2007 | Jones | 210/162 |

* cited by examiner

*Primary Examiner* — Eileen D Lillis
*Assistant Examiner* — Chi Nguyen
(74) *Attorney, Agent, or Firm* — Keaty Law Firm LLC

(57) ABSTRACT

A support assembly for supporting a retrofit roof to be installed above an existing roof made of preformed panels. Elongated support assembly members are positioned along the roof line to provide additional points of attachment for the new roof, while at the same time forming a substantially even plane for new rood panels. Some of the support members fit in the channels between the ridges of the preformed panels, which can be R-panels or standing seam panels. Transverse top members secure the channel-mounted members in place, while strapping members positioned atop the top members form additional lateral support for the new roof.

20 Claims, 7 Drawing Sheets

RETROFIT FRAMING SYSTEM FOR METAL ROOF

BACKGROUND OF THE INVENTION

This invention relates to roofing systems, and, more particularly to a support assembly for retrofitting a roof made of preformed panels in order to improve wind pressure resistance of a new roof.

The typical roof in a high wind weather condition is degraded and eventually destroyed because one or more roofing panels and/or the ridge caps are lifted off of the structure. When this happens, the entire roof is quickly peeled off of the building and the rest of the building is exposed to the weather. Older roofs, especially those constructed according to the earlier building codes, are particularly susceptible to wind pressure because there are not enough points of attachment of the roof panels to the underlying roof support structure, such as a plywood deck, rafters or purlins.

Rapid changes in the roofing systems bring new concepts to the roofing material development. For instance, preformed metal panels may replace standing seam roof or vice versa, and single-ply membrane may replace the old-fashioned built-up roof or vice versa. Preformed metal panels are often made of galvanized steel with the panel lengths between 6 and 40 feet and panel widths in the order of 26-38". The preformed metal panels may have different patterns, or profiles, wherein the high ridges of the panel are integrally formed with low-profile drain channels. The panels are typically attached along the drain channels at spaced intervals according to the manufacturer's specifications.

In the geographic areas where hurricanes happen every year, the screw-down preformed metal roofs often fail, when high velocity winds rip off the roof from the building. Often times, water and wind enter under the edges of the roof panels and ridge cap thus exposing the building interior to the inclement weather. The purpose of this invention is to provide a retrofitting assembly for standard roof with pre-formed metal roofing panels, standing seam, or other that would increase the roof's resistance to winds of extreme force. With roofing panels, the present invention will confer resistance to all winds, not depending on thru fasteners or flashing with caulk.

SUMMARY OF THE INVENTION

It is, therefore, an object of this invention to provide a retrofitting assembly for retrofitting existing metal roofs with supports for positioning of a new roof.

It is another object of the invention to provide a retrofitting assembly designed to increase wind resistance of the roof.

It is a further object of the invention to provide a retrofitting assembly for reinforcing the roof structure that can be installed on top of the existing roof panels without the need to replace the roof.

It is still a further object of the invention to provide a retrofitting assembly that can be installed over an existing roof and bring the roof into compliance with current building codes without the need to remove the existing roof or to add new framing members to meet new wind load requirements (code).

These and other objects of the invention are achieved through a provision of a roofing system assembly for retrofitting an existing roof formed of preformed roof panels having elevated ridges and drain channels, with new roofing panels, while correcting any uneven planes of the existing roof. The assembly comprises a plurality of support members formed from a corrosion-resistant bendable material, such as for instance galvanized steel or other material. The support assembly comprises a plurality of elongated first bottom members configured to fit into drain channels and be secured to the preformed roof panels to extend about a peripheral line of the roof. Each of the first bottom members has a height at least equal to the height of a ridge of the preformed roof panel so as to support a new roof along an even plane. The assembly also comprises a plurality of elongated first top members configured to extend transversely to the first bottom members and be secured at a level above the elevated ridges of the preformed roof panels, and a plurality of support brackets configured to be positioned in the drain channels and be secured to the preformed roof panels and to the first top members for supporting the first top members at a desired elevation above the elevated ridges of the preformed roof panels.

Elongated strapping members extend transversely to and are configured to be secured to the first top members in substantially parallel relationship to the first bottom members. A second top member is configured for securing along the peripheral edge of the existing roof between the first bottom member and the strapping member. When secured to the existing roof panels, the support assembly forms a framework, to which new roofing panels may be secured.

The new support assembly provides considerable larger number of attachment points for the new roof, particularly along the peripheral roof line. As a result, wind pressure resistance of the building roof is significantly increased.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
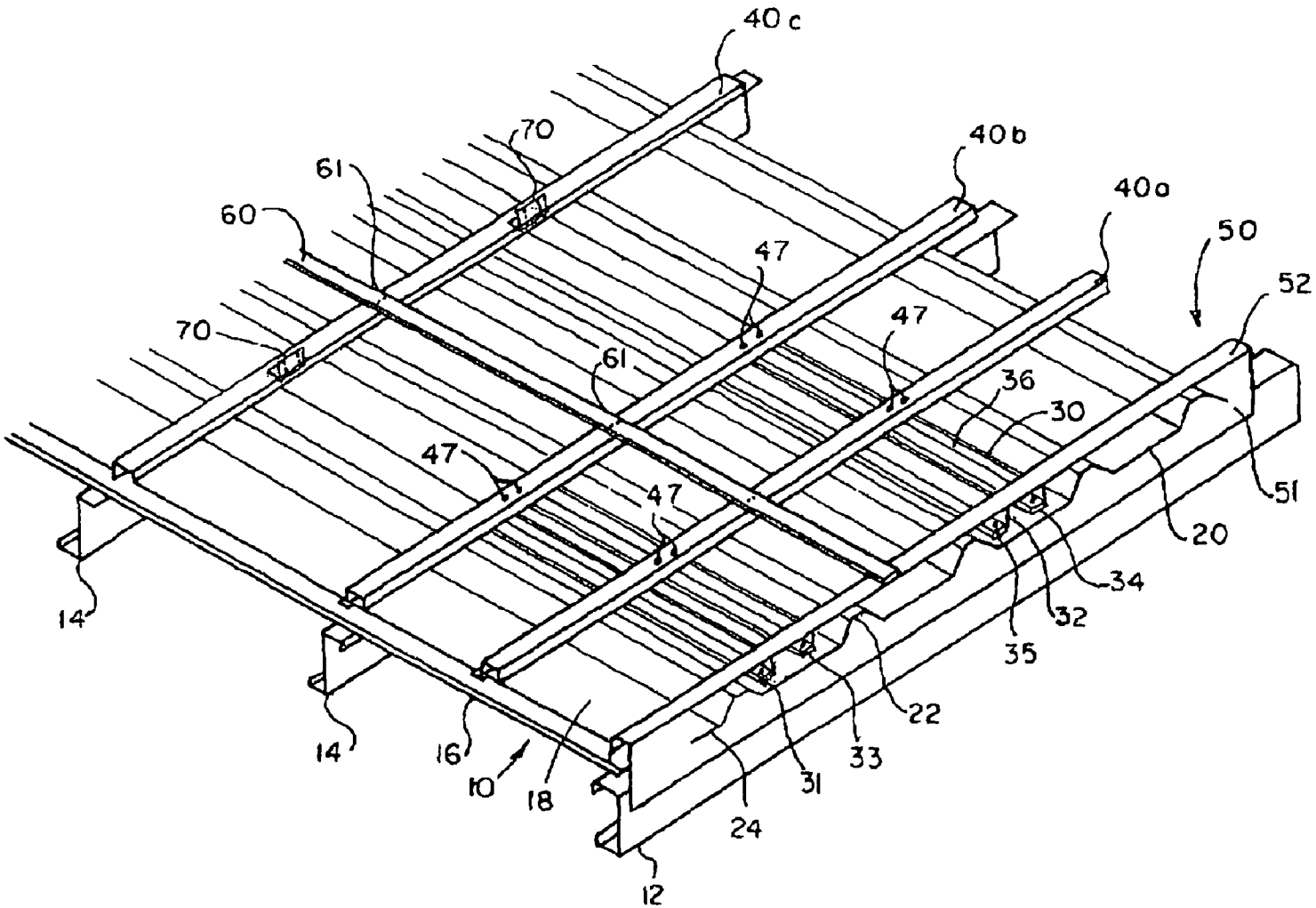
FIG. 1 is a perspective view of a roof having preformed metal panels and having the retrofitting roofing system of the instant invention installed thereon.

Turning now to the drawings in more detail, numeral 10 designates an existing roof made of preformed metal panels 18. The roof illustrated in the drawings is a standard R-panel roof, which is typically made of galvanized steel. Another frequently used alternative in roof panels is the so-called standing seam roof. An eave strut 12 forms the edge of the roof supporting structure and somewhat projects beyond the side of the building in some cases.

A plurality of purlins 14 extends in a generally parallel relationship to the roof edge; the purlins 14 support the loads from the roof deck or sheathing 16. The purlins 14 are supported by the principal rafters and/or the building walls (not shown). As can be seen in the drawings, conventional purlins 14 are formed of Z-shaped sections; they can be formed of cold-formed steel. The purlins 14 are spaced from each other by about 4 feet or more. The roof panels 18 are corrugated, with high ridges 22 alternating with drain channels 24.

A first bottom support member 30 is configured to fit within the channel 24. The first bottom support member 30 has a length sufficient to extend between a peripheral edge 20 of the panel 18 and at least the first purlin 14 depending on the wind pressure resistance. A plurality of bottom support members 30 is positioned in the drain channels 24 at pre-determined spaced intervals. Depending on the condition of the old roof, a first bottom member may be positioned in every drain channel 24 or every other drain channel 24, or at any other desired spacing depending on the wind pressure resistance.

Each bottom support member 30 has a pair of sloping sides 32, 34 joined by an elevated flat ridge 36. A flange 31 extends outwardly from a lower end of the side 32, and a mirror-image flange 33 extends outwardly from a lower end of the side 34. The flanges 31 and 33 are configured to be secured to the roof panels 18 by screws 35. The height of the first bottom member, that is the distance by which the flat ridge 36 extends above the flanges 31, 33, is at least equal to, or slightly greater than the distance between the plain of the drain channel 24 and the high ridge 22. Attachment method and quantity of fasteners is determined by wind load, also the existing structure determines attachment method and quantity of fasteners.

Figure 2:
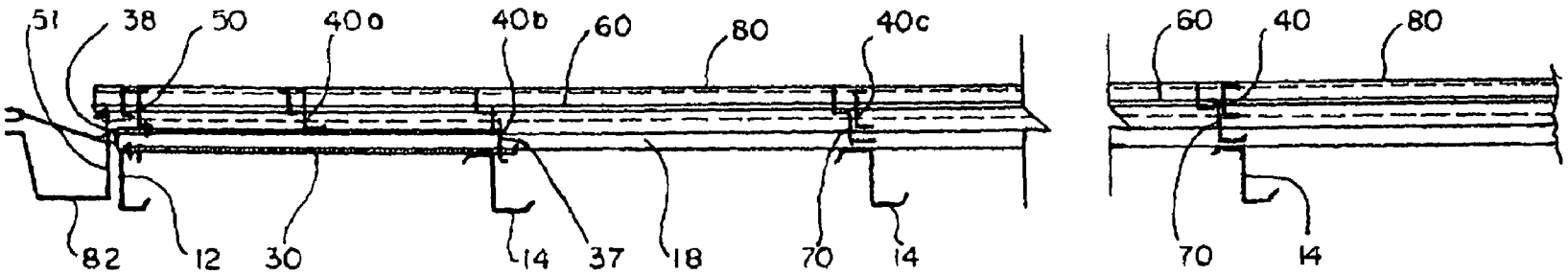
FIG. 2 is a cross-sectional view illustrating position of the attachment members along the edge of the roof.

Extending transversely to the longitudinal axis of the first bottom member 30 is an elongated first top member 40. The first top member 40 has a generally Z-shaped configuration; it has a first horizontal part 42, a vertical part 43, a second horizontal part 45 and an angularly descending part 46. The first horizontal part 42 is configured to rest on the first bottom member 30, as shown in FIG. 2, and be attached thereto by screws. The second horizontal part 45 supports a strapping member 60, as will be described below.

The assembly of the present invention provides for the use of at least one, and preferably several first top members 40. A first top member 40*a* is secured to inner ends 37 as seen in FIG. 2 of each of the first bottom members 30. In one of the embodiments, the flat top ridge 36 is attached by two screws of approximately ¼". In many cases the size of the fastening mechanism is determined by a construction engineer or wind load requirement. In one of the preferred embodiments another first top member 40*b* is secured midway between outer ends 38 and inner ends 37 as seen in FIG. 2 of the first bottom members 30. Still another first top member 40*c* is secured a distance inwardly of the first top member 40*b* to provide structural support for the new roof 80 held level by the strapping member 60. The first top members 40a and 40*b* are secured to the first bottom members 30 by screws 47. The first top members 40*a* and 40*b*, etc. are new attachment points added to the structure. Note first bottom members 30 can be longer and placed in more frequent arrangement points as needed and as determined by existing eave height, slope of the roof, and windload requirements. Note that members 12 and 14 are part of the existing roof to which the present invention is retrofitted. Purlins 14 are integral to the existing roof and are usually spaced on centers either 3 feet, 4 feet, or 5 feet typically. As indicated previously numeral 10 designates the existing metal roof which is made out of consecutively placed panels 18 for further clarification member 12 refers to the existing roof's eave purlin. Additional structural members 40*d* can be placed intermittent 40*b* and 40*c* if required and secured to first bottom members 30, which can be as long as needed to satisfy existing windload requirements, which may be influenced or determined by the slope of the roof, etc. If desired, an optional first top member 40d may be secured in parallel relationship to the first top members 40*a* and 40*d*, that is providing additional attachment points for a new roof 80.

Additional first top members 40 are installed at eaves, rakes and ridges over previously installed first bottom members 30. The first top members 40 help in converting existing roof structure and obtain higher wind pressure resistance (wind load rating) or to meet new building codes. The top members 40 can be secured at various points along its vertical part 43, thus allowing the installer to slightly elevate the elongated first top member 40 to the desired height and achieve an even roof line, as described below.

Figure 7:
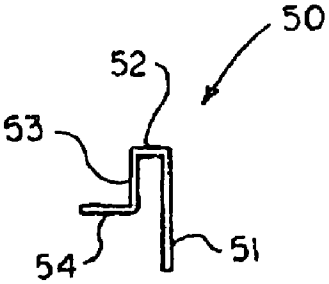
FIG. 7 is an end view of the second top member.

A second top member 50 is secured to the flat ridge 36 of the bottom member 30 by inserting fastener members through the lower horizontal segment 54 of the second top member 50 and the flat ridge 36 of the first bottom member 30. Quantity and size of screw is determined by an engineer for specific load requirements. Top member 50 provides a covering relationship over the edge of the roof panels 18 and the outer ends 38 of the first bottom members 30. As can be seen in FIGS. 1 and 7, the second top member 50 comprises a first longer elongated vertically extending segment 51, a first or upper horizontal segment 52, a second or shorter vertical segment 53 and a second or lower horizontal segment 54. The size and the angle of connection between the long vertical segment 51 and the upper horizontal segment 52 is determined by the configuration of the existing structure; the length of the long segment 51 is determined by the height of the first bottom members 30. Similar to the first top member 40, the second top member 50 can be made from galvanized steel. The segments 51, 52, 53 and 54 can be formed unitary, as shown in FIG. 7. As can be seen in FIG. 1, the first top member 50 is installed in a covering relationship over portions of the first bottom member 30 of the existing roof 18 and eave struts 12.

When the second top member 50 is positioned on the first bottom member 30, the lower horizontal segment 54 rests on the flat ridge 36 of the first bottom member 30, and the long vertical segment 51 partially covers the eave 12. When the strapping members 60 are positioned on the roof they rest on, and are secured to, the upper horizontal segment 52 of the second top member 50, as shown in FIG. 1. An optional gutter member 82 may be secured to the vertical portion of the first top member, as shown in FIG. 2.

The strapping members 60 span from the second top member 50 toward the field of the roof, preferably to the sub-framing ridge 76. The lateral strapping members 60 can be formed from sheet metal about 2 inches wide. As discussed above, the strapping members 60 are attached to the flat second horizontal parts 45 of the second top members 40 by flat head screws or tapping screws 61.

The strapping members 60 are spaced from each other, with the distance between the strapping members to be determined by an engineer or by the requirements of the wind load resistance. The strapping members are made of thin piece of tin or galvanized steel. The strapping members 60 can span from one edge of the roof to another edge to form lateral support for a new roof. Alternatively, the strapping members 60 can stop at the sub framing ridge 76, and another strapping member 60 can start to span to another edge of the roof.

Figure 8:
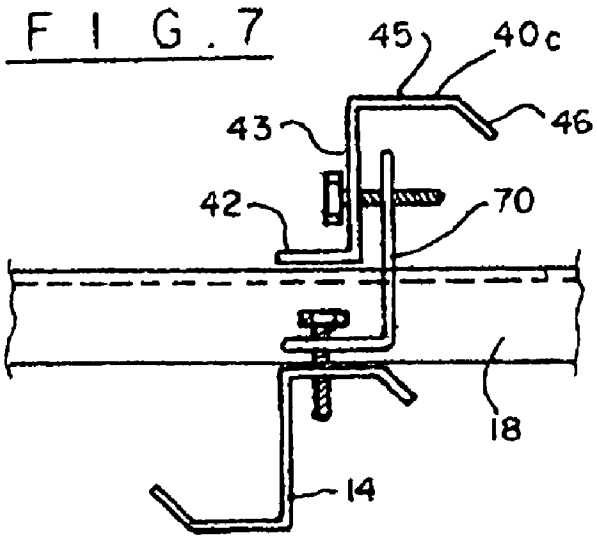
FIG. 8 is a detail view showing engagement of a bottom bracket with a first top member.
Figure 6:
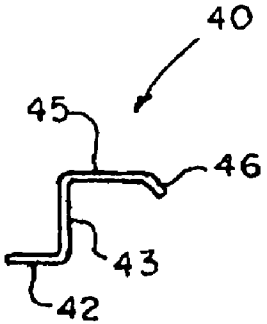
FIG. 6 is an end view of the first top member.
Figure 9:
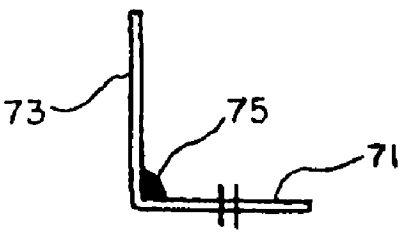
FIG. 9 is a detail view of the bracket member.
Figure 5:
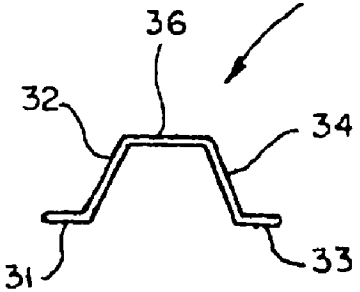
FIG. 5 is an end view of the first bottom support member.

The first top member 40*c* is secured to the brackets 70, which are spaced from each other as shown in FIG. 1. The brackets 70 can be L-shaped brackets that have a horizontal part 71 configured for attachment to the roof panels 18 and into structure below purlin 14 and a vertical part 73 that fits against the vertical part 43 of the first top member 40*c* (see FIG. 8), and is secured by screws to the vertical part 43. A gusset 75 is fitted between the parts 71,73 of the L shaped bracket 70 to insure integrity of the bracket structure. The vertical part 73 of the bracket 70 can be made of any desired height. The vertical part of the bracket 70 can be made of any required height to allow the first top member 40C to be elevated from the surface of the roofing panel 18 and form a straight roof line, as needed.

Figure 4:
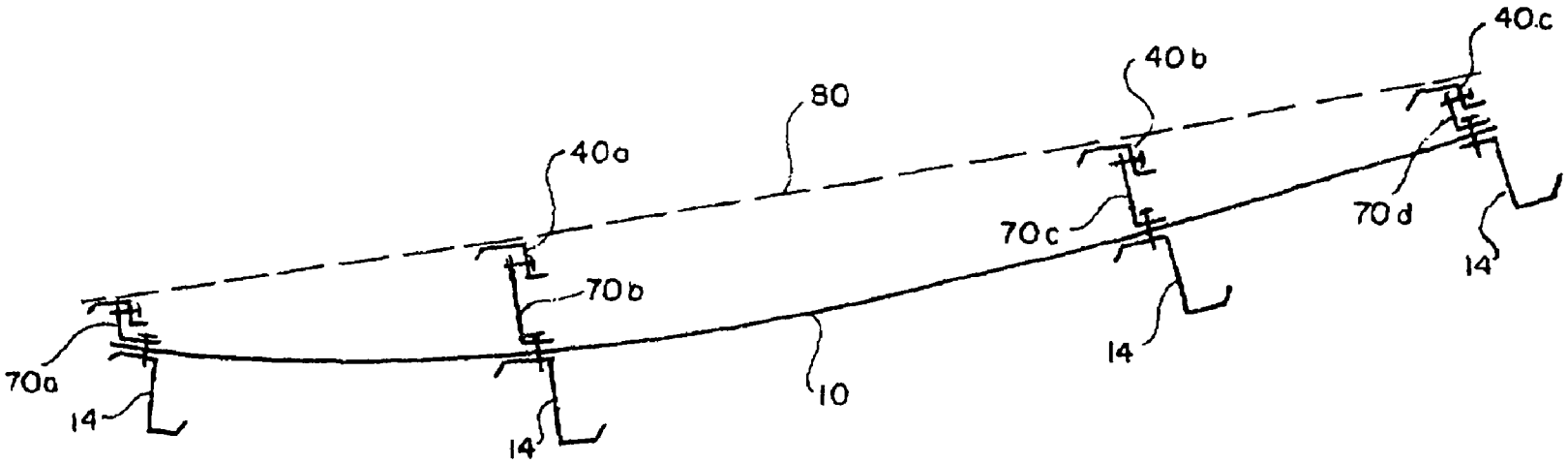
FIG. 4 is a schematic view illustrating position of the attachment members between the old roof and a new roof, which illustrates attachment points in the field of the roof showing taller bottom members depending on the slope variance in the existing structure

As discussed above, with time, such roofs may have altered roof plane such as for instance illustrated in FIG. 4, which makes it extremely difficult to repair. In many instances, the metal panels corrode or crack and need to be patched or completely replaced. In many climates, replacement of the existing roof must be done expeditiously for fear of exposing the interior of the building to frequent rains. The present invention permits a roofer to re-align the roof supporting surface to prepare the roof for new roof panels. The different sizes of bracket 70 can make up the difference between unlevel roofs. Taller brackets 70 can also be used if owner or architect require additional air apace for thermal reasons or can give additional options for thicker insulation if desired. Brackets have to be attached through panel into structure below only. They cannot be installed to panel only. Brackets 70 are only used to transmit existing attachment points through panel 18. Whereas first bottom member 30 is installed is where additional attachment points can be provided.

As schematically illustrated in FIG. 4, the old roof line 10 became uneven, and the support assembly of the instant invention elevated the support structure to level the roof. In FIG. 4, a plurality of support brackets 70 is provided for supporting, along with the first top members 40, a new roof 80. In this example, brackets 70*a* and 70*d* have smaller vertical parts than the vertical parts of the brackets 70*b* or 70*c* to compensate for the uneven plane in the roofing panels 18.

Figure 3:
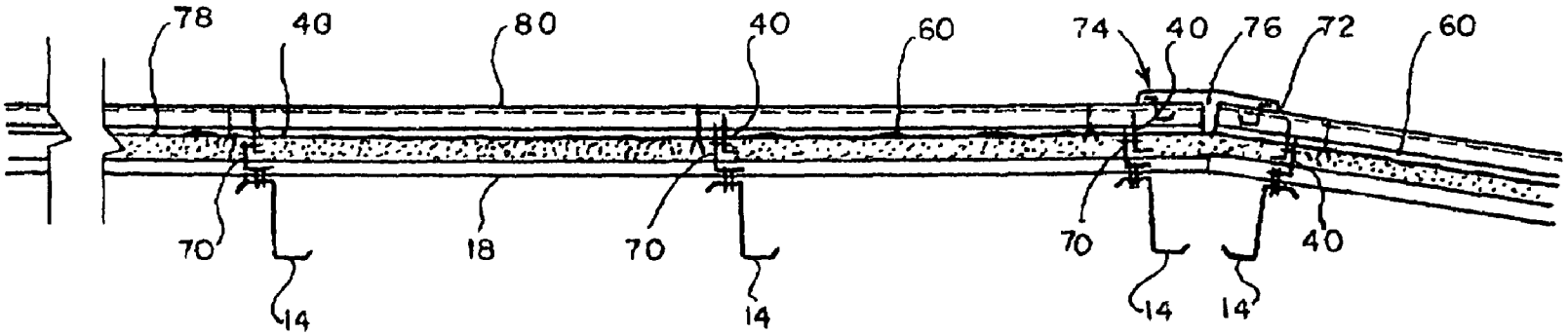
FIG. 3 is a cross-sectional view illustrating position of the attachment members near the ridge of the roof.

FIG. 3 illustrates the support assembly of the instant invention of the roof near a ridge of the roof. As can be seen in the drawing, a pair of first top support members 40 is engaged with the optional sub-ridge 72, which can be made of galvanized steel. The sub-ridge 72 attaches to the second flat horizontal part 45 of the first top member 40. It is envisioned that the sub-ridge 72 may be used in case when a customer want to support top new roof panel using the ridge 74. The ridge 74 may be provided with a ridge vent 76 to allow ventilation. If desired, a layer of insulation 78 may be positioned in the space between the old roof panels 18 and the new roof panels 80. In some particular cases that is retrofitting roofs of steeper slopes, that is slopes 2/12 and greater, attachment points for the new panels may need to be greater, therefore, additional bottom members 30 can be installed at the ridge to provide additional attachment points that may be required as a result of the greater slope.

The new roof panels 80 are positioned on top of the first top members 40, the second top member 50 and the strapping members 60. A new eave flashing 84 is placed along the edge of the roof in an overlapping relationship to the second top member 50. The roof panels 80 may be either R-panels or standing seam panels, similar to the panels shown in FIG. 10. Suitable clips 86 secure the panels 80.

Figure 10:
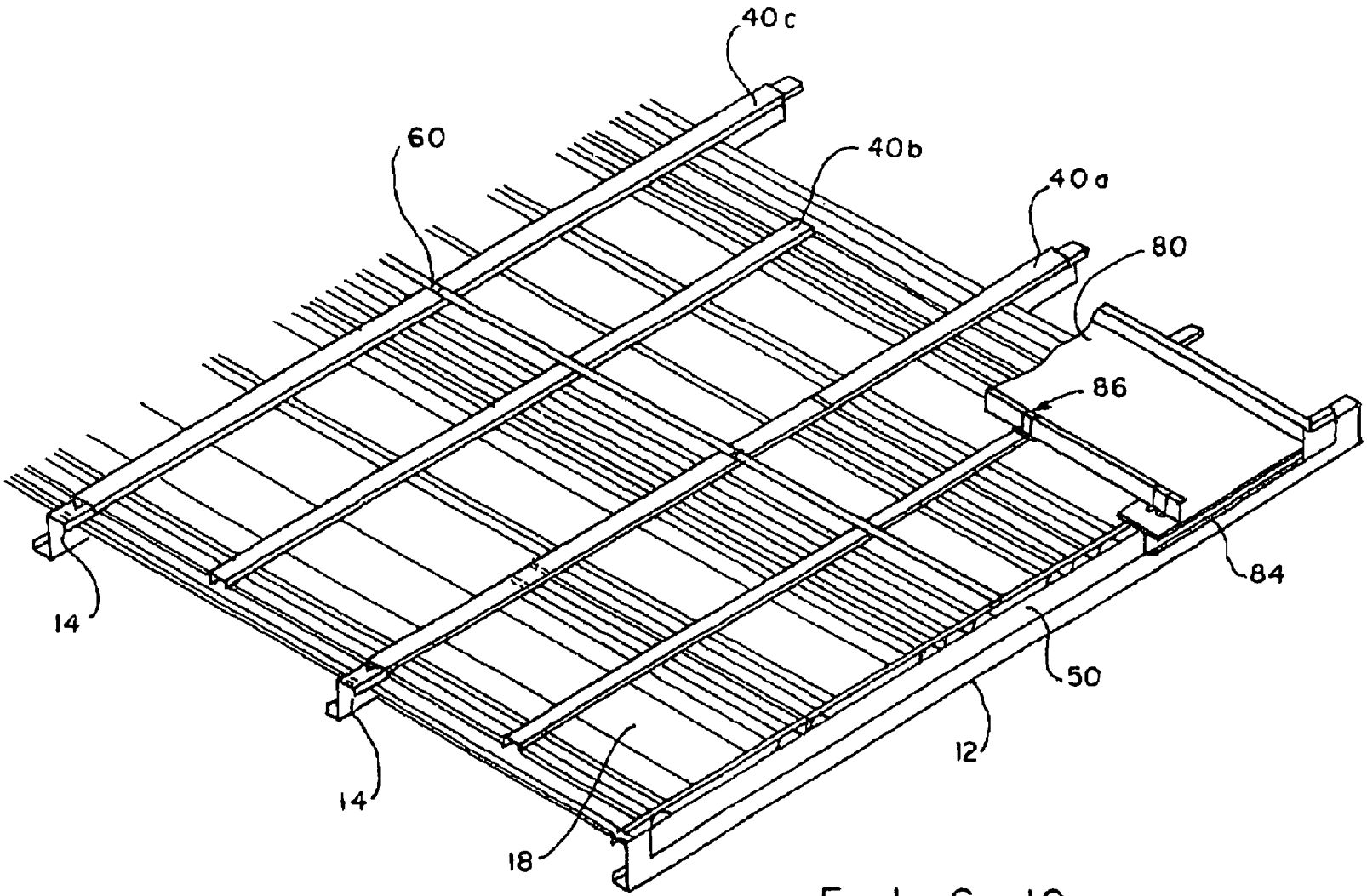
FIG. 10 is a perspective view showing the support assembly of the instant invention with a segment of a new roof panel installed.
Figure 11:
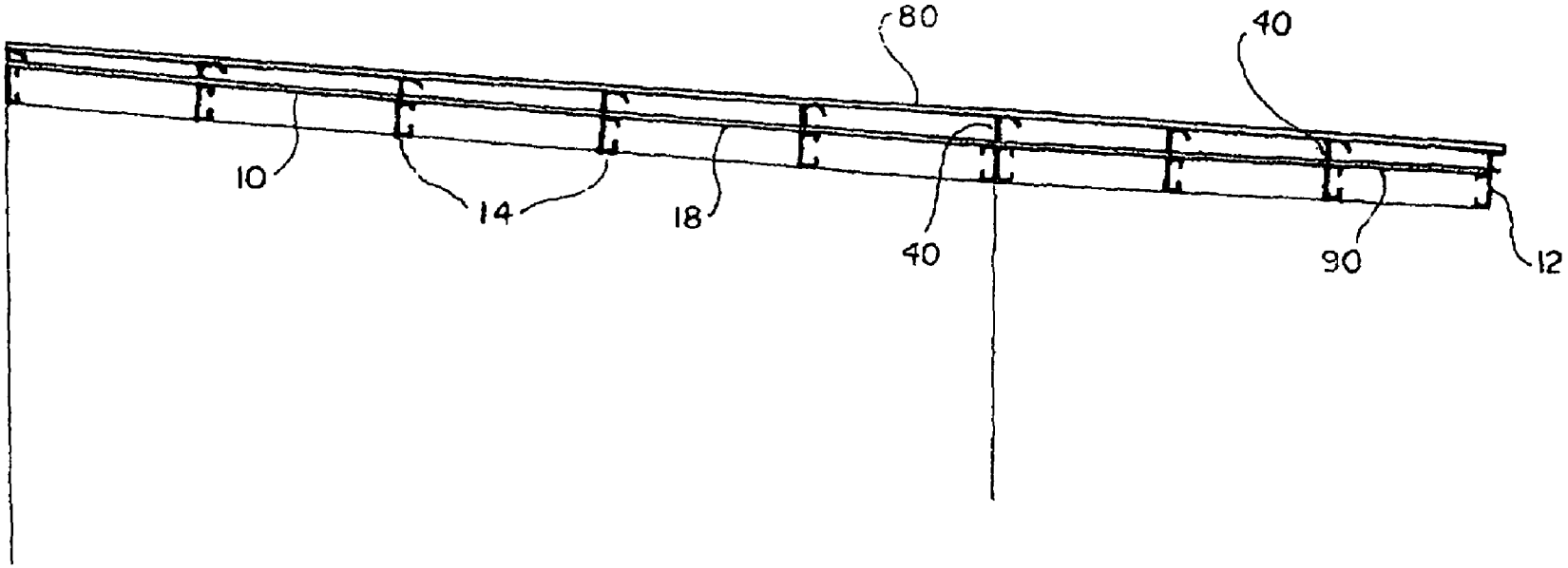
FIG. 11 is an end view of the support assembly of the instant invention supporting a new roof line, and also showing the support assembly correcting a slope variance in existing structure where no slope variance was present.

FIG. 11 illustrates a new roof line created by the panels 80. The new roof line is relatively straight, eliminates sagging, and has a significantly greater number of attachment points, particularly along the peripheral line of the roof. FIG. 10 also illustrates how the system of the present invention can be used to make a more stable connection of the roof portions when a building addition was made resulting in an angle change of the roof. The various size brackets 70 are used to lift the supporting structure and eliminate the level disparity between the old roof 10 and the roof 90 of the building addition. As a result, a new continuous roof 80 is positioned over the main building, as well as over the building addition, with the new roof 80 having an even roofline extending along a substantially even plane.

The members of the support assembly, particularly first bottom members 30, first top members, second top members, and strapping members are formed from a corrosion-resistant, bendable material, such as tin, aluminum or galvanized steel. The brackets 70 can be similarly formed from the corrosion-resistant bendable material.

The present invention provides a reinforced attachment of the new roof, particularly along the edge of the roof. It allows installation of a new roof without the need to remove old, sometimes corroded roof panels 18. It eliminates the dangerous task of removing the old panels and solves the landfill problems. The new roof line can be made even, while the gap between the old roof panels and the new roof panels forms an insulation barrier, even if an insulation layer is not placed between the roofs. As a result the R-value of the new roof is significantly increased.

The instant invention allows quick retrofitting of the existing roof without having to rip off the existing roof and expose the contents of the building to rain, wind and dust. The center of the roof usually does not need reinforcement. Therefore the system of the present invention is particularly useful in reinforcing the peripheral edge of the building roof. It is envisioned that the wind load (wind pressure resistance) can be improved from 100 mph to about 130-140 mph.

Many changes and modifications can be made in the system of the present invention without departing from the spirit thereof. I, therefore, pray that my rights to the present invention be limited only by the scope of the appended claims.

I claim:

1. A roofing system support assembly installed above an existing roof formed of preformed roof panels having elevated ridges and drain channels, the assembly comprising:

a plurality of elongated bottom members fit into drain channels of the existing roof and be secured to the preformed roof panels of the existing roof to extend about a peripheral line of the existing roof, each said bottom members having a height at least equal to the height of an elevated a ridge of the preformed roof panel;

a plurality of elongated first top members extending transversely to the bottom members and be secured at a level above the elevated ridges of the preformed roof panels, said first top members having a generally Z-shaped configuration;

a plurality of support brackets positioned in the drain channels and be secured to the preformed roof panels and to the first top members for supporting the first top members at a desired elevation above the elevated ridges of the preformed roof panels; and a plurality of strapping members extending transversely to the first top members and be secured to the first top members.

2. The assembly of claim 1, wherein said support assembly supports a new roof above an existing roof, while forming a level support for the new roof.

3. The assembly of claim 1, wherein each of said bottom members comprises an elongated body having a flat ridge, a pair of oppositely sloping sides and a flange extending outwardly from each of said sloping sides.

4. The assembly of claim 3, wherein each of said first top members comprises an elongated body having a first horizontal part securing to the flat ridge of the bottom member, a vertical part extending upwardly from said first horizontal part, a second horizontal part extending transversely from the vertical part and an angularly extending part unitary secured to the second horizontal part.

5. The assembly of claim 4, wherein each of said support brackets comprises an L-shaped body having a horizontal portion and a vertical portion, wherein said horizontal portion be secured to the preformed roof panel, while the vertical portion secured to the vertical part of the first top member.

6. The assembly of claim 1, wherein each of said support brackets has a generally L-shaped body having a horizontal portion and a vertical portion, and wherein the vertical portion has a pre-determined sufficient longitudinal dimensions to support a roof to be installed on the support assembly along a substantially even plane.

7. The assembly of claim 1, further comprising a second top member secured to the first bottom members along a peripheral edge of the existing roof.

8. The assembly of claim 7, wherein said second top member comprises an elongated body having a first vertical segment extending along an eave of the existing roof, an upper horizontal segment extending transversely to the first vertical segment, a second vertical segment unitary connected to the upper horizontal segment and extending transversely to the upper horizontal segment, and a second horizontal segment unitary connected to the second vertical segment and extending transversely to the second vertical segment.

9. The assembly of claim 8, wherein the second horizontal segment is secured atop the bottom member.

10. The assembly of claim 8, wherein the first vertical segment has pre-determined longitudinal dimensions at least slightly greater than pre-determined longitudinal dimensions of the second vertical segment.

11. The assembly of claim 7, wherein each of said bottom members, said first top members, and said second top members is formed from a corrosion-resistant bendable material.

12. The assembly of claim 1, further comprising a gutter member secured to the first top member.

13. A roofing system assembly installed above an existing roof formed of preformed roof panels having elevated ridges and drain channels, with new roofing panels, the assembly comprising:

a plurality of elongated bottom members fit into drain channels of the existing roof and be secured to the preformed roof panels of the existing roof to extend about a peripheral line of the existing roof, each said bottom members having a height at least equal to the height of a ridge of the preformed roof panel;

a plurality of elongated first top members extending transversely to the bottom members and be secured at a level above the elevated ridges of the preformed roof panels, said first top members having a generally Z-shaped configuration;

a plurality of support brackets be positioned in the drain channels and be secured to the preformed roof panels and to the first top members for supporting the first top members at a desired elevation above the elevated ridges of the preformed roof panels;

a plurality of strapping members extending transversely to the first top members and be secured to the first top members; and a second top member securing along the peripheral edge of the existing roof between the first bottom member and the strapping member, said assembly forming a support for new roofing panels.

14. The assembly of claim 13, wherein each of said bottom members comprises an elongated body having a flat ridge, a pair of oppositely sloping sides and a flange extending outwardly from each of said sloping sides.

15. The assembly of claim 14, wherein each of said first top members comprises an elongated body having a first horizontal part securing to the flat ridge of the bottom member, a vertical part extending upwardly from said first horizontal part, a second horizontal part extending transversely from the vertical part and an angularly extending part unitary secured to the second horizontal part.

16. The assembly of claim 15, wherein each of said support brackets comprises an L-shaped body having a horizontal portion and a vertical portion, wherein said horizontal portion is be secured to the preformed roof panel, while the vertical portion is be secured to the vertical part of the first top member.

17. The assembly of claim 13, further comprising a second top member secured to the bottom members along a peripheral edge of the existing roof, said second top member comprising an elongated body having a first vertical segment extending along an eave of the existing roof, an upper horizontal segment extending transversely to the first vertical segment, a second vertical segment unitary connected to the upper horizontal segment and extending transversely to the upper horizontal segment, and a second horizontal segment unitary connected to the second vertical segment and extending transversely to the second vertical segment, said first vertical segment having longitudinal dimensions at least slightly greater than longitudinal dimensions of the second vertical segment.

18. The assembly of claim 17, wherein the second horizontal segment secured atop the first bottom member.

19. The assembly of claim 17, wherein each of said bottom members, said first top members, said second top members, and said strapping members is formed from a corrosion-resistant bendable material.

20. The assembly of claim 13, further comprising a gutter member secured to the first top member.

* * * * *